US012195940B2

(12) United States Patent
Klein et al.

(10) Patent No.: US 12,195,940 B2
(45) Date of Patent: Jan. 14, 2025

(54) VIBRATOR ARRANGEMENT FOR IMPROVING BUILDING SOIL

(71) Applicant: Keller Holding GmbH, Offenbach/Main (DE)

(72) Inventors: Kuno Klein, Offenburg (DE); Victor Maurier, Strasbourg (FR); Uwe Schmidt, Renchen (DE)

(73) Assignee: Keller Holding GmbH, Offenbach/Main (DE)

( * ) Notice: Subject to any disclaimer, the term of this patent is extended or adjusted under 35 U.S.C. 154(b) by 717 days.

(21) Appl. No.: 17/377,704

(22) Filed: Jul. 16, 2021

(65) Prior Publication Data

US 2021/0340717 A1 Nov. 4, 2021

Related U.S. Application Data

(63) Continuation of application No. PCT/EP2019/051295, filed on Jan. 18, 2019.

(51) Int. Cl.
*E02D 7/18* (2006.01)
*E02D 3/054* (2006.01)

(52) U.S. Cl.
CPC ..... *E02D 7/18* (2013.01); *E02D 3/054* (2013.01)

(58) Field of Classification Search
CPC ..... E02D 7/18; E02D 3/054; E02D 5/665; E02D 3/08; E02D 3/123
See application file for complete search history.

(56) References Cited

U.S. PATENT DOCUMENTS 4,158,518 A * 6/1979 Rusche ..... E02D 15/04 405/242
4,269,544 A * 5/1981 Rusche ..... E02D 5/38 405/239
4,384,809 A * 5/1983 Rusche ..... E02D 15/04 405/243

(Continued)

FOREIGN PATENT DOCUMENTS

| | | |
|---|---|---|
| CN | 2871646 | 2/2007 |
| DE | 102011006735 | 10/2012 |
| EP | 0861944 | 9/1998 |

(Continued)

OTHER PUBLICATIONS

EP 2241677 A1—Translation.*
International Search Report for International Application PCT/EP2019/051295, mailed Aug. 21, 2019.

*Primary Examiner* — Kyle Armstrong
(74) *Attorney, Agent, or Firm* — Burris Law, PLLC

(57) ABSTRACT

A vibrator arrangement for building soil improvement includes a sluice with a silo tube and a sluice drive for moving the sluice. The sluice is adapted to receive a bulk material and to guide the bulk material into the silo tube. A feed container for feeding the bulk material to the sluice is included and a feed container drive is provided for moving the feed container between a waiting position and an abutment position at the sluice. Also, a method for transferring bulk material from a feed container into a sluice with a silo tube of a vibrator device includes moving the sluice with a sluice drive and moving the feed container filled with the bulk material a between a waiting position and an abutment position at the sluice while the sluice is moving.

18 Claims, 7 Drawing Sheets

(56) References Cited

U.S. PATENT DOCUMENTS 5,980,161 A * 11/1999 Degen ..... E02D 5/40
405/232
9,546,464 B2 * 1/2017 Degen ..... E02D 3/046

FOREIGN PATENT DOCUMENTS

| | | |
|---|---|---|
| EP | 2241677 | 10/2010 |
| FR | 2261375 | 9/1975 |

* cited by examiner

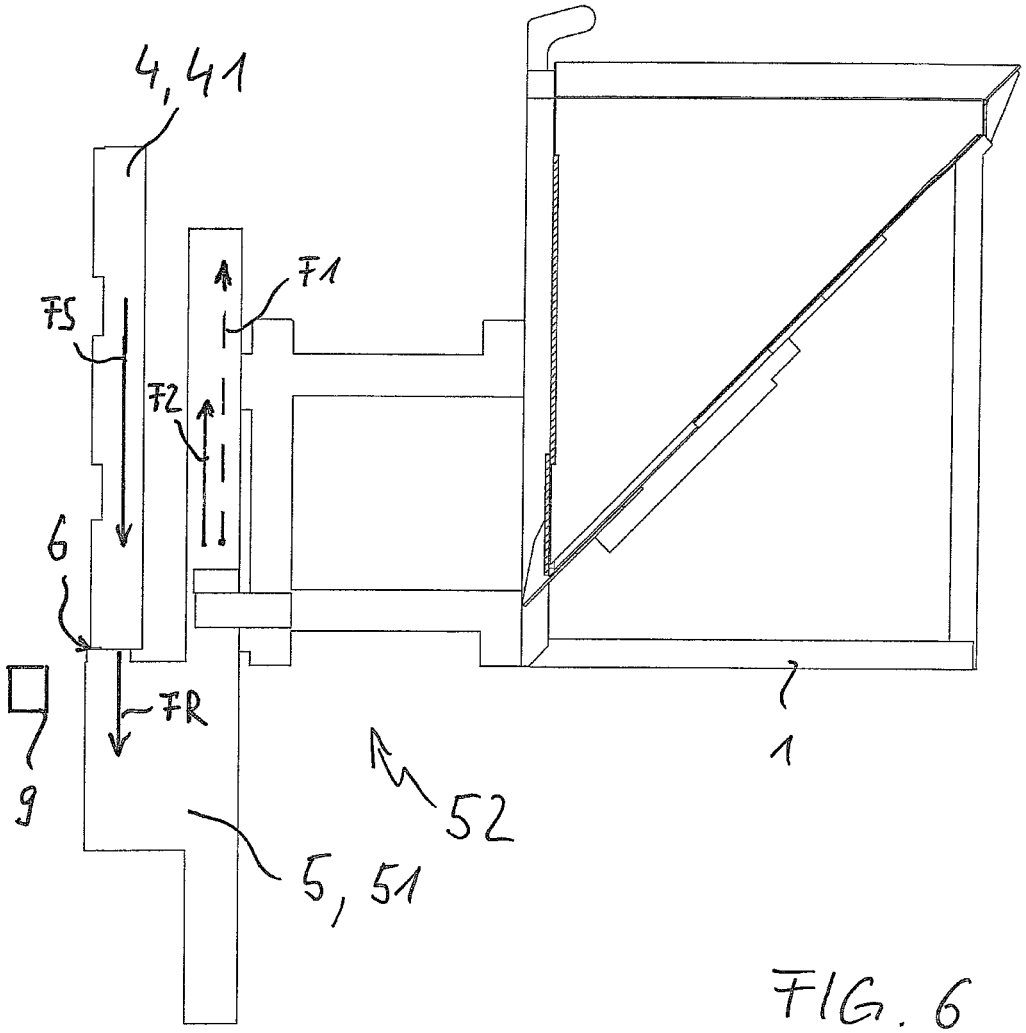
FIG. 6
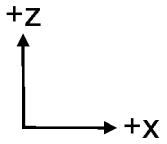

VIBRATOR ARRANGEMENT FOR IMPROVING BUILDING SOIL

CROSS-REFERENCE TO RELATED APPLICATIONS

This application is a continuation of International Application No. PCT/EP2019/051295, filed on Jan. 18, 2019. The disclosure of the above application is incorporated herein by reference.

FIELD

The present disclosure relates to a vibrator arrangement for building soil improvement.

BACKGROUND

The statements in this section merely provide background information related to the present disclosure and may not constitute prior art.

Vibrator arrangements are used in methods of building soil improvement, which differ with regard to the mode of action and load transfer. With the vibro-compaction method, for example, coarse-grained soils are compacted in themselves, while with the vibro-replacement method, load-bearing columns of gravel or crushed stone are produced in mixed and fine-grained soils that are not capable of compaction. Furthermore, pile-like foundation elements can be produced, through which relatively high loads can be transferred, if a permanent load-bearing connection with replacement columns is not guaranteed.

Publication EP 2 241 677 A1 discloses a device for feeding inert materials to vibrating soil compaction systems on a compaction device having a tower or arm for supporting a drill battery. The inert material is fed to the drill battery from a sluice. The funnel-shaped feeder device is moved between a first lower level near the ground and a second level at which the sluice is located. The feeder device is provided with an openable outlet flap to transfer the inert material from the feeder device to the sluice. The outlet flap is opened by mechanical means on the device and the sluice.

For example, in the vibro-replacement method, work is carried out in alternating steps. Gravel or crushed stone that emerges during the vibrator stroke is compacted during pressing and displaced laterally into the ground. The coarse-grained addition material is discharged at the tip of the vibrator with the aid of compressed air. For this purpose, the system is supplied with compressed air, which supports the transport of the bulk material within the system. A disadvantage of the prior art system is that the feed device can only be docked to the sluice when the sluice is not in an upward or downward motion. If there is a collision between the sluice and the feeder device, this can cause the rope to break, causing the feeder device to fall. In addition, the entire system must be vented before the sluice can be opened. This leads to considerable downtimes. The process can only be continued when the bulk material has been transferred into the sluice and the working air pressure has been reached again after closing the sluice.

SUMMARY

This section provides a general summary of the disclosure and is not a comprehensive disclosure of its full scope or all of its features.

A vibrator arrangement and a method for building soil improvement, which make it possible to reduce the downtime, are provided.

A vibrator arrangement for building soil improvement according to the teachings of the present disclosure has a sluice with a silo tube and with a sluice drive for moving the sluice, wherein the sluice is arranged to receive a bulk material and to guide it into the silo tube. Further, a feed container is provided to feed the bulk material to the sluice, wherein a feed container drive is provided to move the feed container between a waiting position and an abutment position at a stop formed on the sluice.

The sluice and the feed container are each guided, for example, on a lead or via a rope on a boom. The sluice drive is independent of the feed container drive. Corresponding guides and drives of the sluice and the feed container are known to the skilled person, as well as vibrators for generating a vibration of the vibrator arrangement, which is preferably arranged with such a vibrator as a deep vibrator or as a top vibrator.

According to the present disclosure, a controller of the feed container drive is adapted to reduce a force of the feed container drive towards the stop from a first value to a second value when in the abutment position, the second value having a smaller absolute value than a force of the sluice drive.

An advantage of the vibrator arrangement according to the present disclosure is that the first value of the force of the feed container drive is suitable to move the feed container from the waiting position to the abutment position at the stop formed at the sluice, while the force of the feed container drive reduced to the second value couples the feed container to the sluice by holding the feed container in the abutment position at the stop by the force of the feed container drive reduced to the second value. Particularly advantageously, this coupling of the feed container with the sluice works independently of a movement of the sluice, since the force of the feed container drive reduced to the second value has a smaller absolute value than a force of the sluice drive.

For the purposes of the present disclosure, sluice drive force refers to a drive force of the sluice drive acting on the sluice. Other forces acting on the sluice do not count towards the force of the sluice drive. For the purposes of the present disclosure, feed container drive force means a drive force of the feed container drive acting on the feed container. Other forces acting on the feed container do not count towards the force of the feed container drive. Other forces may include, for example, the driving force of the other drive or weight forces acting on the feed container or silo.

During operation of the vibrator arrangement, for example during the vibro-replacement method, the sluice with the silo tube is pulled out of a borehole against the direction of gravity during the vibrator stroke and is retracted into the borehole in the direction of gravity during pressing. The vibrator arrangement according to the present disclosure advantageously allows the coupling described above both during the vibrator stroke and during the retraction of the sluice. This reduces the downtime of the vibrator arrangement, as the sluice does not have to be stopped for the coupling process.

According to one form of the present disclosure, the feed container drive controller is further configured to maintain the force of the feed container drive acting in the direction of the stop after reaching the abutment position during a transfer of bulk material from the feed container into the sluice. The bulk material is thus advantageously taken over during the vibrator stroke or during the retraction of the vibrator arrangement.

During the vibrator stroke, the force of the sluice drive moves the sluice upwards, against the direction of gravity. The force of the feed container drive, reduced to the second value, is also upwardly directed and, in the case, is sufficient to move the feed container upwardly, at a speed at least equal to the speed of the sluice, so that the sluice and the feed container remain coupled. Preferably, the movement of the feed container is decelerated by the sluice so that part of the force of the feed container drive acts on the sluice via the stop.

During retraction, the force of the sluice drive moves the sluice downwards, in the direction of gravity. The force of the feed container drive, reduced to the second value, is still directed upwards, against the force of the sluice drive. Since this force is smaller than the force of the sluice drive, the feed container is pressed downwards by the sluice.

Likewise, the takeover process can take place during a transition from pulling out the sluice to retracting the sluice or vice versa. The direction of the force of the sluice drive is thereby reversed, whereby the force of the feed container drive reduced to the second value after reversal of the direction of the force of the sluice drive again has a smaller absolute value than the force of the sluice drive. The skilled person will recognize that in the transition phase, the force of the feed container drive reduced to the second value will be temporarily greater in absolute value than the force of the sluice drive, thereby not disengaging the coupling of the feed container to the sluice.

Preferably, the feed container drive controller is further configured to move the feed container from the abutment position upon completion of the transfer of bulk material. The coupling is thus advantageously released again and the feed container returns to the waiting position by means of the feed container drive until bulk material is to be transferred to the sluice again.

The waiting position in the sense of the present disclosure is a position of the feed container which is located away from the sluice. In particular, the waiting position is arranged such that the sluice does not reach this position during regular operation, so that the movement of the sluice is not hindered by the feed container being in the waiting position. The waiting position is not necessarily an unchangeable position. The waiting position is preferably variable in location. For example, the waiting position is defined at a fixed distance from the sluice so that the waiting position also moves when the sluice moves. The waiting position is preferably the position in which the feed container is filled with the bulk material. The abutment position in the sense of the present disclosure is defined by the stop on the sluice and thus moves with the sluice.

In some variations, it is provided that at least two different sensors are connected to the controller system for determining a position of the feed container relative to the sluice. In particular, a sensor is provided to detect an approach of the feed container to the abutment position, for example to reduce a travel speed of the feed container. A further sensor is designed to detect when the abutment position is reached and to send a signal to the controller system accordingly.

In at least one variation, it is provided that the feed container drive comprises a hydraulic motor, wherein a bypass is provided in parallel with the hydraulic motor, the bypass comprising a bypass valve to open and close the bypass. In particular, the force of the feed container drive is advantageously reduced from the first value to the second value when the bypass is open. For this purpose, the bypass has, for example, an adjustable pressure relief valve.

In some variations, it is provided that the sluice comprises a closable outlet, wherein the outlet is opened to direct the bulk material from the sluice into the silo tube. Further preferably, the sluice comprises a closable inlet, wherein the inlet is opened to receive the bulk material from the feed container. In such variations it is particularly advantageous because the silo tube can be pressure-ventilated. The two closable openings of the sluice, the inlet and the outlet, allow the bulk material to be transferred from the feed container into the sluice without having to vent the pressure-ventilated silo tube. Preferably, it is further provided that the sluice is supplied with compressed air independently of the silo tube. If the sluice is vented to transfer the bulk material while the silo tube, separated from the sluice by the closed outlet, remains pressurized, it is advantageously possible to pressurize the sluice after completion of the takeover with the inlet and outlet closed to establish pressure balancing between the sluice and the silo tube before the outlet is opened.

When driving the vibrator arrangement into the ground, it may be advantageous, depending on the ground conditions, either to initially drive the silo tube in without bulk material, or to fill it completely or partially with bulk material. The correct decision, usually based on experience, allows, for example, to avoid jammers in the soil or to make it easier to retract the vibrator assembly. The empty silo tube is preferably supplied with compressed air when the outlet is closed. The sluice preferably remains depressurized, especially preferably with the inlet open. When bulk material is then fed in, there is a time saving advantage as the feed container can transfer the bulk material without delay to the sluice with the inlet already open. In addition, the filling of the sluice with compressed air and the venting are economized. This is made possible by the outlet, which separates the sluice from the silo tube.

Before a complete pull out of the vibrator assembly from the soil, it is advantageous to vent the sluice and the silo tube via two valves without opening the inlet or the outlet of the sluice. This avoids in particular that in the last section, before the vibrator arrangement is driven out of the ground, a blow-out of the compressed air occurs, which would mean a risk of injury by stones flying around. Furthermore, the sluice and the silo tube can be opened and filled more quickly.

The present disclosure provides a method of transferring bulk material from a feed container into a sluice having a silo tube at a vibrator device, wherein the sluice is moved by a sluice drive, wherein the feed container is filled with the bulk material and wherein the feed container is moved by a feed container drive between a waiting position and an abutment position at the sluice.

The present disclosure also provides a method of transferring bulk material from a feed container to a sluice comprising a silo tube in a vibrator arrangement, the vibrator arrangement preferably corresponding to the vibrator arrangement according to the present disclosure described above. All features of the vibrator arrangement can be applied mutatis mutandis to the process and vice versa.

In the method according to the present disclosure, the sluice is moved by a sluice drive, the feed container is filled with the bulk material and the feed container is moved by a feed container drive between a waiting position and an abutment position at a stop formed on the sluice. In the abutment position, a force of the feed container drive towards the stop is reduced from a first value to a second value, wherein the second value has a smaller absolute value than a drive force of the sluice drive.

An advantage of the method is that the first value of the force of the feed container drive is adapted to move the feed container from the waiting position to the abutment position against the stop formed on the sluice, while the force of the feed container drive reduced to the second value couples the feed container to the sluice by holding the feed container in the abutment position against the stop by the force of the feed container drive reduced to the second value. Particularly advantageously, this coupling of the feed container to the sluice is performed independently of a movement of the sluice, since the force of the feed container drive reduced to the second value has a smaller magnitude than a force of the sluice drive.

Preferably, the feed container is held in the abutment position by the force reduced to the second value when the sluice is moved. In particular, the feed container is held in the abutment position when the sluice is moved in a first direction towards the waiting position by moving the feed container together with the sluice in the first direction, wherein a driving force of the sluice drive acts on the feed container via the stop and overcomes the force of the feed container drive reduced to the second value. In particular, the feed container is held in the abutment position when the sluice is moved in a second direction opposite to the first direction by the feed container following the stop in the second direction by the force of the feed container drive reduced to the second value.

Preferably, it is provided that at least a portion of the bulk material is transferred from the feed container into the sluice while the feed container is held in the abutment position. Particularly preferably, after reaching the abutment position, a closable outlet between the pressure-ventilated silo tube and the sluice is closed, the sluice being subsequently vented separately via a valve before a closable inlet of the sluice is opened. It is further preferred that the bulk material is transferred through the inlet from the feed container into the sluice, wherein the feed container is moved synchronously with the sluice during the transfer operation. After taking over the bulk material, the inlet is preferably closed first and then the outlet is opened. In some variations, the sluice is pressurized independently of the silo tube while the inlet and outlet are closed to balance pressure between the sluice and the silo tube before the outlet is opened.

After the bulk material has been taken over, the feed container is preferably moved into the waiting position. The feed container preferably remains in the waiting position until the sluice is to be filled with bulk material again. Particularly preferably, the feed container is filled with the bulk material in the waiting position.

More detail with reference to the accompanying drawings and by way of an example of at least one form of the present disclosure is provided below. The explanations refer to the vibrator arrangement according to the present disclosure as well as to the method according to the present disclosure. The forms and variations described herein are merely exemplary and do not limit the general idea or the teachings of the present disclosure.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
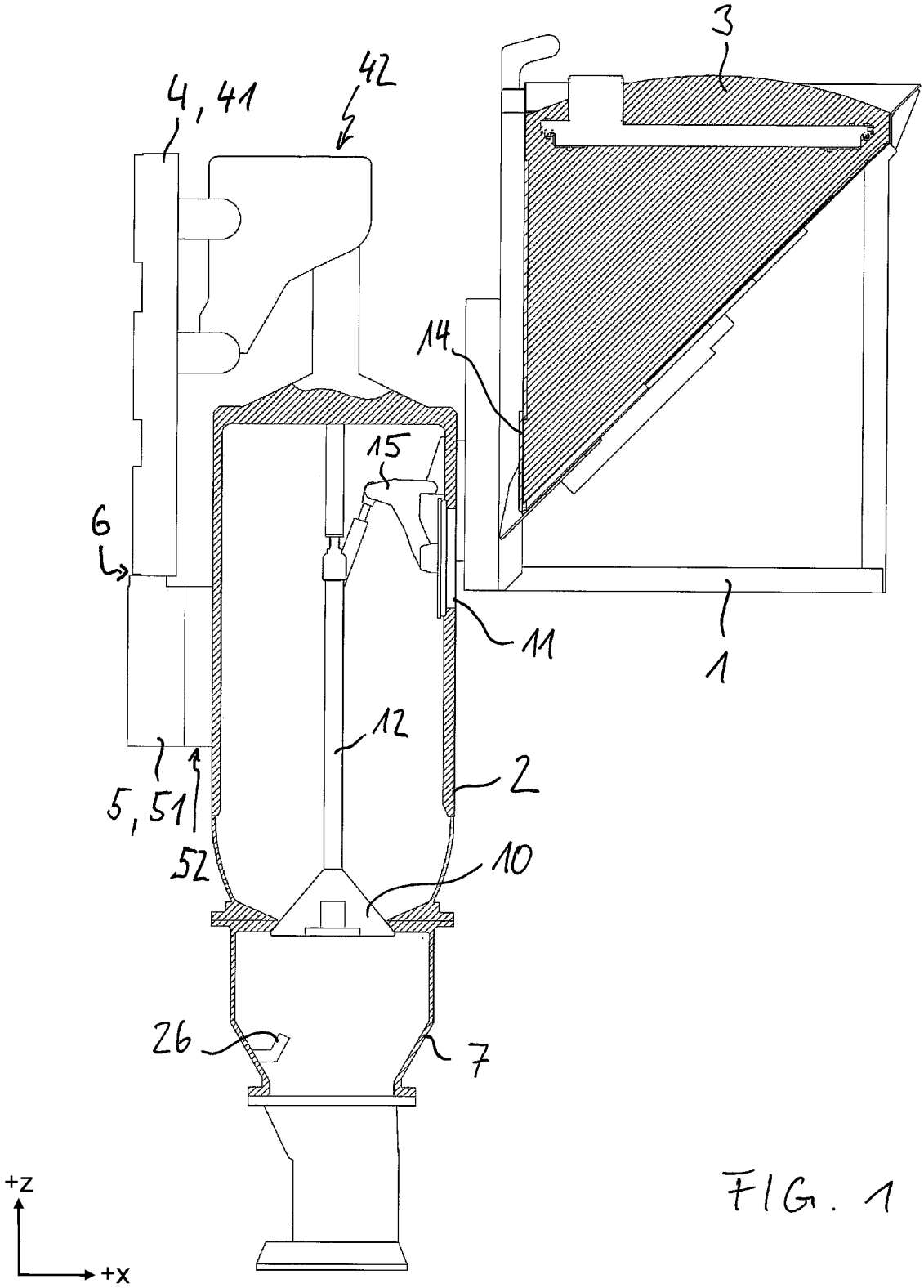
FIG. 1 shows one form of a vibrator arrangement according to the teachings of the present disclosure with a feed container in an abutment position on a sluice in a schematic sectional view.
Figure 7:
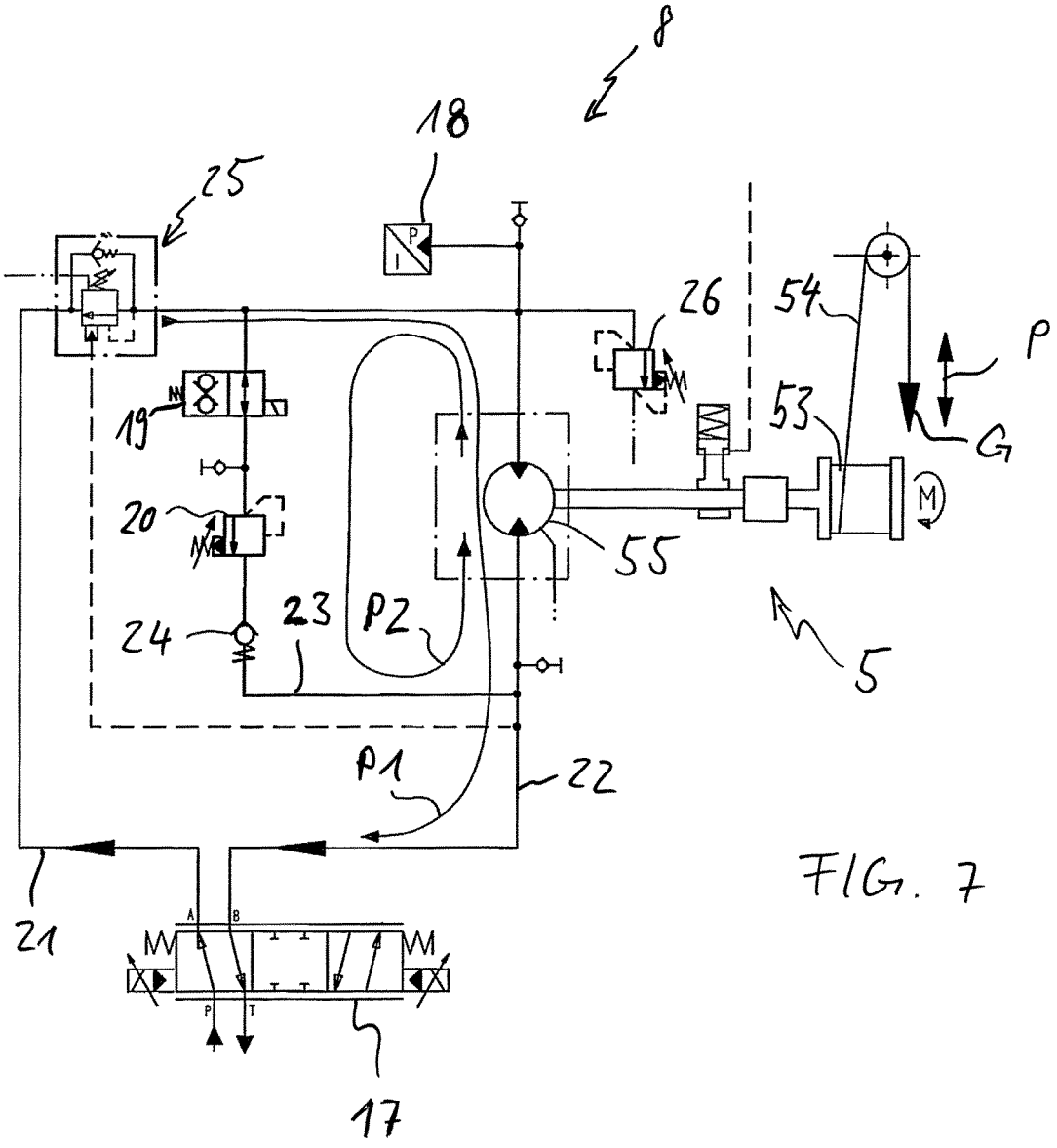

FIG. 6 a detail of the form according to FIG. 1 in a schematic sectional view without the sluice;

FIG. 7 is a schematic representation of a controller system for the feed container drive of the form according to FIG. 1.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

FIGS. 1 to 5 show one form of a vibrator arrangement (also referred to herein simply as a "vibrator") according to the teachings of the present disclosure with a feed container 1 and a sluice 2 in a schematic sectional view in various positions respectively in various working steps. With reference to the figures, it will be explained how a transfer of bulk material 3 from the feed container 1 into the sluice 2 takes place in the vibrator arrangement.

Figure 2:
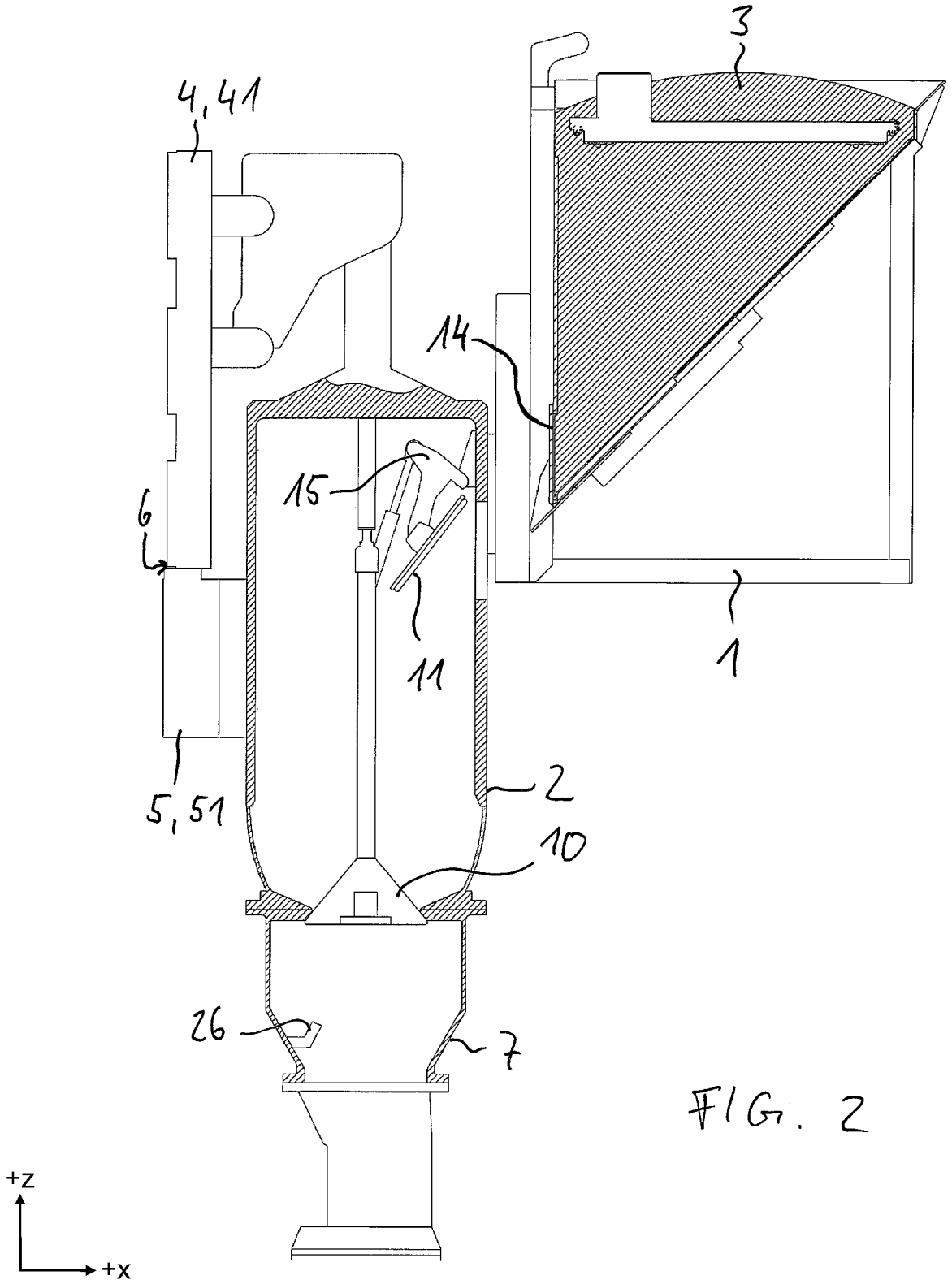
FIG. 2 shows the form according to FIG. 1 with an open inlet of the sluice in a schematic sectional view.
Figure 3:
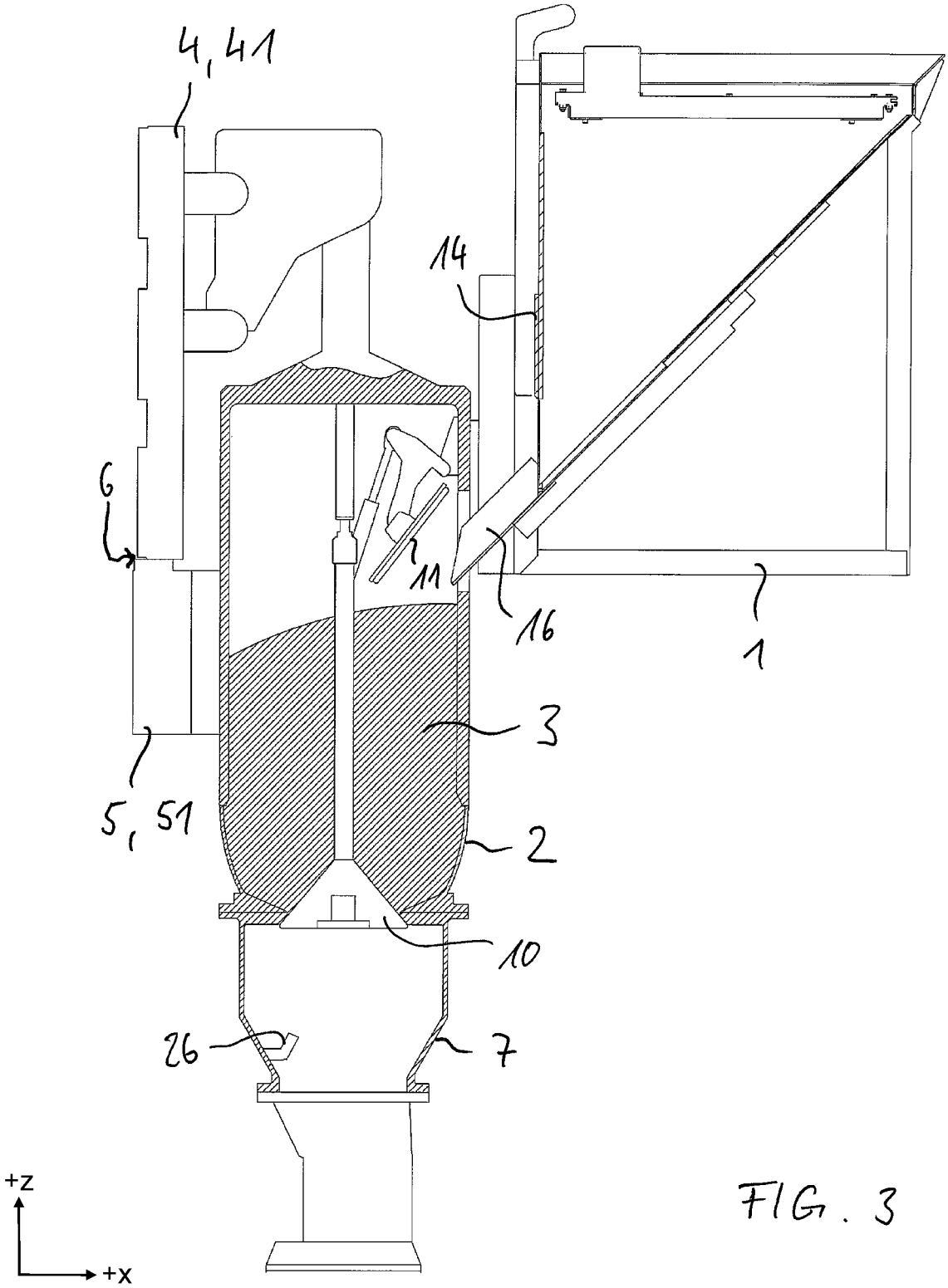
FIG. 3 shows a schematic sectional view of the form according to FIG. 1 after a transfer of bulk material.
Figure 4:
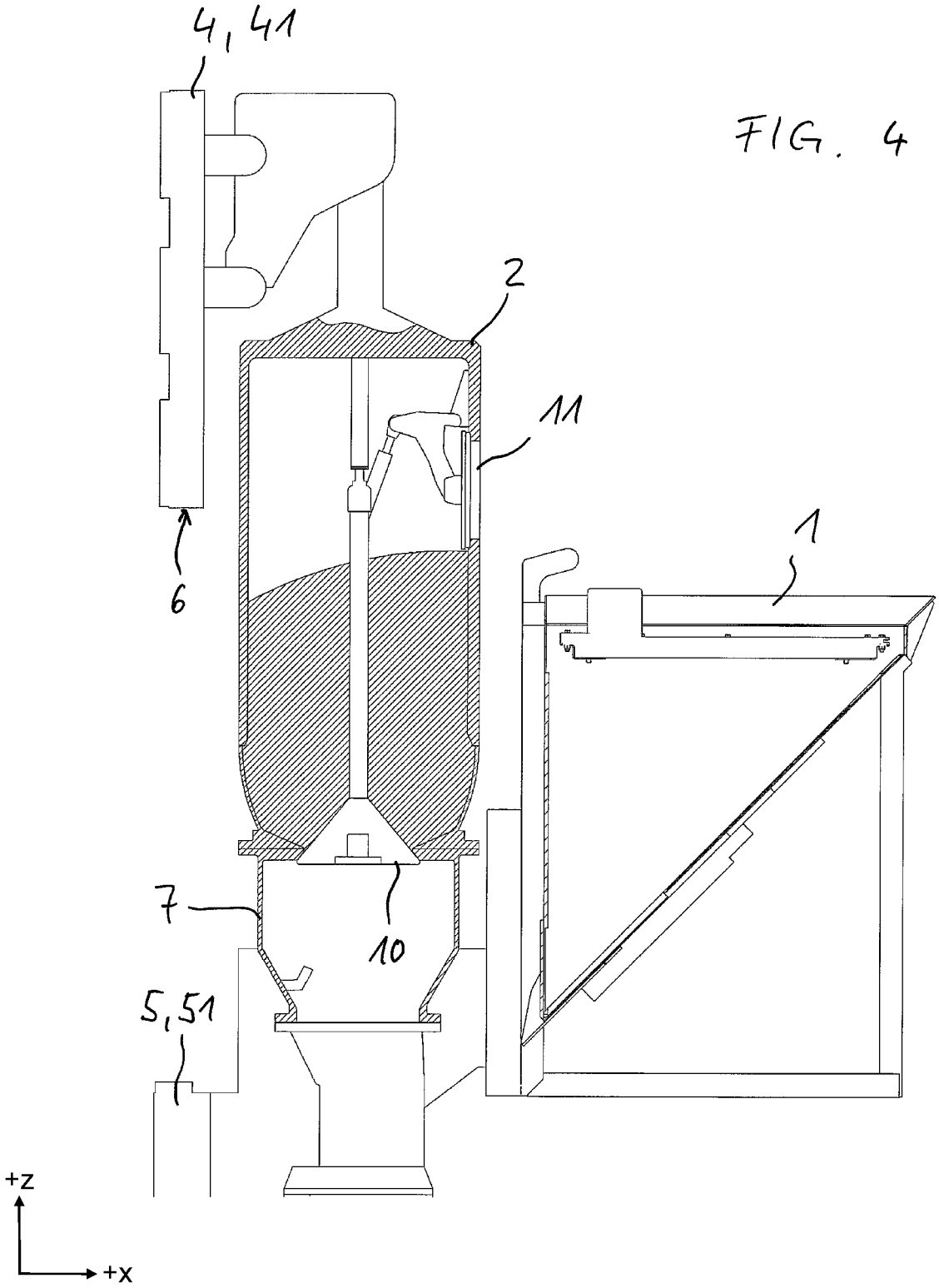
FIG. 4 shows the form according to FIG. 1 with the feed container in a waiting position in a schematic sectional view.
Figure 5:
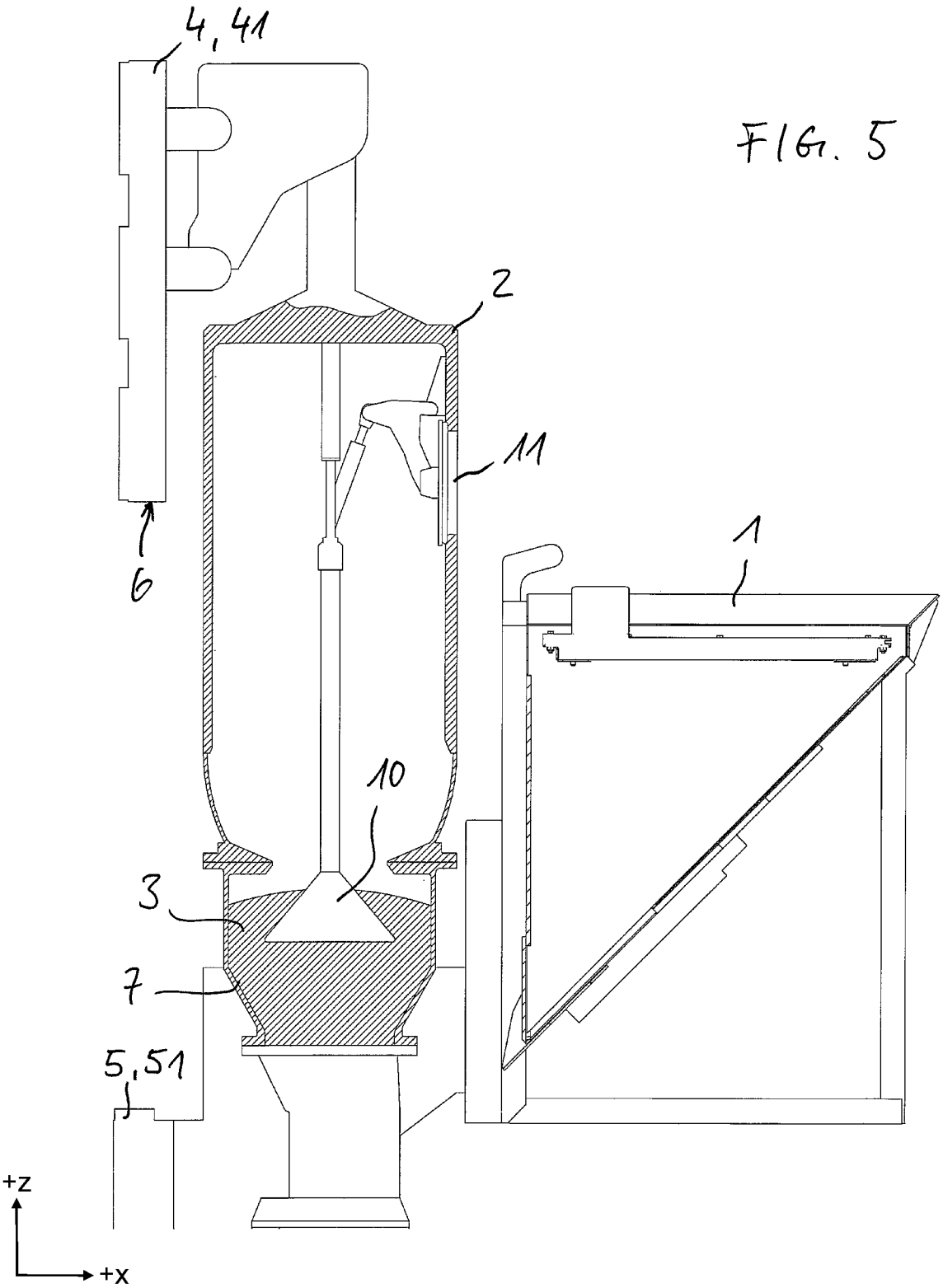
FIG. 5 shows the form according to FIG. 1 with an open outlet of the sluice in a schematic sectional view.

The sluice 2 has a sluice drive 4 with which the sluice 2 is moved. As part of the sluice drive 4, a guide carriage 41 of the sluice 2 is shown in FIG. 1, which is guided in a known manner on a lead not shown. The sluice drive 4 transmits a driving force to the guide carriage 41 of the sluice 2, which is connected to the guide carriage 41 via a mounting 42. The feed container 1 is moved by a feed container drive 5 between a waiting position, as shown in FIGS. 4 and 5, and an abutment position, as shown in FIGS. 1 to 3. In the abutment position, the feed container 1 is located at a stop 6 formed at the sluice 2. In the illustrated form, the stop 6 is formed on the guide carriage 41 of the sluice 2. Upon reaching the abutment position, a force of the feed container drive 5 towards the stop 6 is reduced from a first value to a second value, the second value having a smaller absolute value than a driving force of the sluice drive 4. With reference to FIG. 7, a controller 8 of the feed container drive 5 will be explained in more detail at a later stage. Of the feed container drive 5, a guide carriage 51 of the feed container 1 is shown in FIG. 1, which is also guided in a known manner on a lead which is not shown. The feed container drive 5 transmits a driving force to the guide carriage 51 of the feed container 1, which is connected to the guide carriage 51 via a mounting 52. In the following description of FIGS. 1 to 6, the guide carriage 41 is also referred to as the sluice drive 4 by way of representation and the guide carriage 51 is also referred to as the feed container drive 5, since the respective drive forces are transmitted to the corresponding guide carriage 41, 51.

The sluice 2 has a closable outlet 10 (e.g., a conical closure 10) and an inlet 11 which is also closable, wherein in FIG. 1 both the closable outlet 10 and the inlet 11 are closed. The closable outlet 10 is formed as a conical closure at a lower end (−z direction) of the sluice 2, to which an upper end (+z direction) of a silo tube 7 is flanged, so that the closable outlet 10 can uncover and close an opening between the sluice 2 and the silo tube 7. For this purpose, a seat for the conical closure 10 is formed at the opening, which is generally provided with a rubber sealing to provide a substantially gas-tight closure even if small amounts of the bulk material remain between the conical closure 10 and the seal. The conical closure 10, as well as its seat, can be cleaned with supplied cleaning fluid via a nozzle 26 in the silo tube 7, also referred to as a cleaning element. An actuating linkage 12 is connected to the outlet 10, which in some variations is hydraulically actuated. The silo tube 7 is pressurized in some variations to assist an outlet of coarse bulk material at a lower end of the silo tube 7, which is not shown, e.g., by compressed air. Advantageously, the closable outlet 10 allows the inlet 11 of the sluice to be opened in the closed position without venting the silo tube 7.

With reference to FIG. 2, inlet 11 is explained in more. The inlet 11 is designed as a pivotable flap in an upper region (+z direction) of a wall of the sluice 2, which in the abutment position according to FIG. 1 is aligned with respect to an outlet opening 14 of the feed container 1 in such a way that the transfer of the bulk material 3 from the feed container 1 into the sluice 2 is possible. The inlet 11 is pivotable by means of a pivot mechanism 15 for opening and closing, preferably by hydraulic actuation. In FIG. 2, the inlet 11 is shown open, with the outlet opening 14 of the feed container 1 still closed. Since the outlet 10 of the sluice 2 is closed, the silo tube 7 remains pressurized while the sluice 2 is ready to receive the bulk material 3. The sluice 2 according to the present disclosure forms an additional reservoir with a double opening mechanism, comprising the inlet 11 and the outlet 10. Thus, the sluice 2 forms a pressure container which, on the one hand, can receive the bulk material 3 and, on the other hand, can be separately aerated and deaerated.

FIG. 3 shows the vibrator arrangement according to the present disclosure chronologically after the situation shown in FIG. 2. That is, the feed container 1 is further in the abutment position against the stop 6 formed at the sluice 2, by the force of the feed container drive 5 which operates against the stop 6 and the outlet opening 14 of the feed container 1 is open such that the bulk material 3 has been transferred from the feed container 1 to the sluice 2 via a bulk chute 16 through the open outlet opening 14 and the open inlet 11. The outlet 10 of the sluice 2 is still closed, so that the pressure ventilation of the silo tube 7 is maintained.

FIG. 4 shows the vibrator arrangement according to the present disclosure chronologically after the situation shown in FIG. 3. That is, after the bulk material 3 has been transferred from the feed container 1 to the sluice 2, the feed container 1 has left the abutment position at the stop 6. The feed container drive 5 has moved the feed container 1 to a waiting position. The waiting position is characterized in that the feed container 1 is arranged remote from the sluice 2, in this case along the not shown lead at a distance below the sluice 2. The sluice 2 can be moved independently of the feed container 1 as long as the latter is arranged in the waiting position. The feed container 1 can, for example, be refilled with bulk material in the waiting position. At sluice 2, inlet 11 is closed again. The outlet 10 is provided to direct the bulk material 3 from the sluice 2 into the silo tube 7. However, the outlet 10 is still closed. In some variations the sluice 2 can now be pressure-ventilated separately before the outlet 10 is opened, in order to adapt the pressure conditions of the sluice 2 to the silo tube 7 again.

FIG. 5 shows the vibrator arrangement according to the present disclosure chronologically after the situation shown in FIG. 4. The outlet 10 has been opened so that the bulk material 3 has passed from the sluice 2 into the silo tube 7. The feed container 1 remains unchanged in its waiting position. Subsequently, the outlet 10 is closed again to allow separate venting of the sluice 2 for a subsequent transfer of bulk material. The feed container 1, which has been filled again or continues to be filled with bulk material 3, moves back into the abutment position as shown in FIG. 1 if required. The sequence shown in FIGS. 1 to 5 is repeated several times and thus advantageously permits continuous operation of the vibrator arrangement according to the present disclosure.

With reference to FIG. 6, a detail of the feed container 1 is explained. The mounting 52 of the feed container 1, which is not fully visible in FIGS. 1 to 5, connects the latter to the guide carriage 51 of the feed container 1. Only the guide carriage 41 of the sluice 2 is shown with the stop 6, wherein the guide carriage 51 of the feed container 1 moves against the stop 6. The abutment position is then reached, in which the force of the feed container drive 5, reduced to the second value, holds the feed container 1. A sensor 9 is provided as a proximity sensor 9 to detect an approach of the guide carriage 51 of the feed container 1 to the stop 6 of the guide carriage 41. Furthermore, FIG. 6 shows the force ratios of the driving forces acting between the guide carriage 51 of the feed container 1 and the guide carriage 41 of the sluice 2, which are transmitted via the stop 6. In the abutment position, the force of the feed container drive 5 in the direction of the stop 6 is reduced from the first force value F1 to the second force value F2, which is why the first force value F1 is represented by a dashed arrow and the second force value F2 is represented by a full line arrow. The force F1 of the feed container drive 5 engages the guide carriage 51 of the feed container 1 and is transmitted to the guide carriage 41 of the sluice 2 via the stop 6. The force FS of the sluice drive 4 engages the guide carriage 41 of the sluice 2 and is opposed to the force F1 of the feed container drive 5. The vibrator assembly is driven into the ground because the force FS of the sluice drive 4 is of a greater absolute value than the reduced force F1 of the feed container drive 5. The resulting force FR is shown accordingly by an arrow on the stop 6. The feed container 1 and the sluice 2 are coupled by the acting forces and are moved together.

In the following, the controller 8 of the feed container drive 5 set up for this purpose is explained in more detail with reference to FIG. 7. The vibrator arrangement according to the present disclosure allows the feed container 1 to be held in the abutment position with the sluice 2, while the sluice 2 is moving. The realization of this synchronization between the feed container 1 and the sluice 2, which allows the transfer of the bulk material 3 previously described with reference to FIGS. 1 to 5, while the vibrator arrangement continues to operate continuously, advantageously avoids downtimes. The synchronization between the feed container 1 and the sluice 2 is necessary because during the transfer of the bulk material the chute 16 enters the sluice 2 through the open inlet 11 (cf. FIG. 3) so that a safe transfer of the bulk material 3 can take place. Otherwise, the chute 16 could be damaged and the bulk material 3 could undesirably fall onto a construction area below. The controller 8 of the feed container drive 5 enables the synchronous movement between the feed container 1 and the sluice 2 to be maintained at the operating speed of the vibrator arrangement during a pull and compaction operation, that is, an upward and downward movement of the vibrator arrangement. For example, the feed container drive 5 and the sluice drive 4 each have a separate hydraulic winch, with only the hydraulic winch 53 of the feed container drive 5 shown in FIG. 7.

For coupling between the feed container 1 and the sluice 2, the guide carriage 51 of the feed container 1 is first moved from the waiting position according to FIG. 5 in the direction of the stop 6 on the guide carriage 41 of the sluice 2. This is preferably done initially in a rapid movement until the proximity sensor 9 (cf. FIG. 6) signals the controller 8 to move the guide carriage 51 in a creep feed movement against the stop 6.

The method according to the present disclosure subsequently provides that a force of the feed container drive 5 in the direction of the stop 6 is reduced from a first value to a second value in the abutment position, the second value having a smaller absolute value than a drive force of the sluice drive 4, which is realized in the form by the controller 8 according to FIG. 7. The guide carriage 51 of the feed container 1 remains actively controlled upwardly via a proportional valve 17 throughout the above described transfer procedure according to FIGS. 1 to 3. Accordingly, the proportional valve 17 is shown in a switching position for movement of the feed container 1 upwards, in the direction of the stop 6. Oil is supplied to a hydraulic motor 55 of the feed container drive 5 via the actively controlled proportional valve 17 through a hydraulic line 21. A return flow of oil on a low-pressure side of the hydraulic motor 55 occurs through the hydraulic line 22. A flow direction of the oil in the illustrated switching position of the proportional valve 17 is shown by directional arrows of the hydraulic lines 21, 22. Switching the proportional valve 17 would cause a downward movement of the feed container 1, for example from the abutment position to the waiting position, which is not shown here. Double-arrow P represents opposite directions of movements upward and downward.

The hydraulic motor 55 of the feed container drive 5 is connected via a shaft to a winch 53, through which a cable 54 connected to the guide carriage 51 of the feed container 1 moves the feed container 1 upwards or downwards. A bypass 23 is provided in parallel with the hydraulic motor 55, the bypass including a bypass valve 19 to open and close the bypass 23. An adjustable pressure relief valve 20 is further arranged in the bypass 23, so that when the bypass 23 is open, the force of the feed container drive 5 is reduced from the first value to the second value defined by the pressure relief valve 20.

After reaching the abutment position, the guide carriage 41 of the sluice 2 determines the movement of the guide carriage 51 of the feed container 1 as it continues to press upwardly against the stop 6 on the guide carriage 41 of the sluice 2. Reaching the abutment position is detected by another sensor 18, in this case a pressure sensor 18, causing the bypass valve 19 to open the bypass 23. For this purpose, in some variations the bypass valve 19 is designed as a 2/2 directional controller valve. A contact pressure is maintained via the pressure relief valve 20, which is set to a fixed pressure value, to generate the force of the feed container drive 5 reduced to the second value. The force reduced to the second value is generated under the contact pressure by the hydraulic motor 55 and transmitted via the winch 53 to the cable 54 connected to the guide carriage 51. A torque arrow denoted by M represents a torque of the feed container drive 5.

In case of an upward movement of the sluice 2 with the feed container 1 in the abutment position, for example when the vibrator arrangement is pulled out, the feed container 1 follows the sluice 2 as a result of the contact pressure defined by the pressure relief valve 20 according to the working speed of the sluice 2. Oil continues to be supplied to the hydraulic motor 55 of the feed container drive 5 via the actively controlled proportional valve 17 through the hydraulic line 21. A flow direction of the oil during the upward movement of the sluice 2 corresponds to the previously described flow direction and is additionally represented by a first arrow P1. However, due to the open bypass 23, the pressure at the hydraulic motor 55 is reduced to the contact pressure in order to generate the force of the feed container drive 5 reduced to the second value. The contact pressure is set by means of the pressure relief valve 20, in particular at least to such a level that the force of the feed container drive 5 generated by the hydraulic motor 55 and reduced to the second value compensates for a weight force of the masses of the feed container 1 and the bulk material 3, and moreover generates the drive force required for the feed container 1 to follow the sluice 2 without delay. The direction of the weight force is indicated by an arrow marked G.

In case of a downward movement of the sluice 2 with the feed container 1 in the abutment position, for example during retraction, impact and vibrating movements, the guide carriage 41 of the sluice 2 presses with a greater force against the guide carriage of the feed container 1. The hydraulic motor 55 of the feed container drive 5 is thus moved against its actual direction of rotation due to the force acting via the winch 53. Since the hydraulic pressure via the proportional valve 17 is greater than the contact pressure defined by the pressure relief valve 20, the oil flows via the open bypass 23, i.e., via the open bypass valve 19, the pressure relief valve 20 and a check valve 24 to the low-pressure side of the hydraulic motor 55, which draws it in to inhibit cavitation. A direction of flow of the oil through the hydraulic motor 55 and the bypass 23 during the downward movement of the sluice 2 is shown by a second arrow P2.

Upon completion of the bulk transfer procedure, the proportional valve 17 is switched (not shown), reversing the direction of force of the feed container drive 5 and causing the feed container 1 to leave the abutment position. The pressure sensor 18 is relieved and closes the bypass valve 19 of the bypass 23. The feed container 1 moves from the abutment position to the waiting position until the next loading process, which is initiated by switching the proportional valve 17 again to the position shown in FIG. 7. The mass of the feed container 1 pulling in the direction of the weight force G is lowered in a controlled manner by a lowering brake holding valve 25. A safety valve 27, here designed as a pressure relief valve, inhibits overloading of the cable 54.

Unless otherwise expressly indicated herein, all numerical values indicating mechanical/thermal properties, compositional percentages, dimensions and/or tolerances, or other characteristics are to be understood as modified by the word "about" or "approximately" in describing the scope of the present disclosure. This modification is desired for various reasons including industrial practice, material, manufacturing, and assembly tolerances, and testing capability.

As used herein, the phrase at least one of A, B, and C should be construed to mean a logical (A OR B OR C), using a non-exclusive logical OR, and should not be construed to mean "at least one of A, at least one of B, and at least one of C."

In this application, the term "controller" and/or "module" may refer to, be part of, or include: an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group) that executes code; a memory circuit (shared, dedicated, or group) that stores code executed by the processor circuit; other suitable hardware components (e.g., op amp circuit integrator as part of the heat flux data module) that provide the described functionality; or a combination of some or all of the above, such as in a system-on-chip.

The term memory is a subset of the term computer-readable medium. The term computer-readable medium, as used herein, does not encompass transitory electrical or electromagnetic signals propagating through a medium (such as on a carrier wave); the term computer-readable medium may therefore be considered tangible and non-transitory. Non-limiting examples of a non-transitory, tangible computer-readable medium are nonvolatile memory circuits (such as a flash memory circuit, an erasable programmable read-only memory circuit, or a mask read-only circuit), volatile memory circuits (such as a static random access memory circuit or a dynamic random access memory circuit), magnetic storage media (such as an analog or digital magnetic tape or a hard disk drive), and optical storage media (such as a CD, a DVD, or a Blu-ray Disc).

The apparatuses and methods described in this application may be partially or fully implemented by a special purpose computer created by configuring a general-purpose computer to execute one or more particular functions embodied in computer programs. The functional blocks, flowchart components, and other elements described above serve as software specifications, which can be translated into the computer programs by the routine work of a skilled technician or programmer.

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. A vibrator for building soil, the vibrator comprising:

a sluice with a silo tube, the sluice being arranged to receive a bulk material and to guide the bulk material into the silo tube, a sluice drive configured to move the sluice by exerting a sluice driving force on the sluice, the sluice driving force being generated by a sluice motor, a feed container configured to feed the bulk material to the sluice, a feed container drive configured to move the feed container between a waiting position and an abutment position against a stop formed on the sluice by exerting a container driving force on the feed container, the container driving force being generated by a container motor, and a controller of the feed container drive configured to reduce the container driving force of the feed container drive in a direction of the stop while in the abutment position from a first value to a second value, wherein the second value has a smaller absolute value than the sluice driving force of the sluice drive.

2. The vibrator according to claim 1, wherein the controller of the feed container drive is configured to maintain the container driving force of the feed container drive acting in the direction of the stop after reaching the abutment position during feeding of the bulk material from the feed container into the sluice.

3. The vibrator according to claim 1, wherein at least two sensors are connected to the controller and configured to determine a position of the feed container relative to the sluice.

4. The vibrator according to claim 3, wherein at least one of the at least two sensors emits a signal when the feed container reaches the abutment position.

5. The vibrator according to claim 1, wherein the container motor of the feed container drive is a hydraulic motor, a bypass being arranged in parallel with the hydraulic motor for fluidically bypassing the hydraulic motor, the bypass comprising a bypass valve configured to open and close the bypass, the bypass valve being controlled by the controller of the feed container drive.

6. The vibrator according to claim 5, wherein the container driving force of the feed container drive has the first value when the bypass is closed and the second value when the bypass is open.

7. The vibrator according to claim 5, wherein the bypass comprises an adjustable pressure relief valve.

8. The vibrator according to claim 1, wherein the sluice comprises a closable outlet, wherein the closable outlet is opened to direct the bulk material from the sluice into the silo tube.

9. The vibrator according to claim 1, wherein the sluice comprises a closable inlet, wherein the closable inlet is opened for taking the bulk material from the feed container into the sluice.

10. A method for transferring bulk material from a feed container into a sluice with a silo tube of a vibrator, the method comprising:

moving the sluice with a sluice drive by exerting a sluice driving force on the sluice, the sluice driving force being generated by a sluice motor, moving the feed container filled with the bulk material from a waiting position to an abutment position against a stop formed on the sluice, wherein the feed container is moved by a feed container drive by exerting a container driving force on the feed container, the container driving force being generated by a container motor, holding the feed container in the abutment position at the stop of the moving sluice by reducing the container driving force of the feed container drive in a direction of the abutment position from a first value to a second value with a smaller absolute value than the sluice driving force of the sluice drive, and transferring at least part of the bulk material from the feed container into the sluice while both the feed container and the sluice are moving.

11. The method according to claim 10, wherein the feed container is held in the abutment position when the sluice is moved in a first direction towards the waiting position by moving the feed container together with the sluice in the first direction, wherein the sluice driving force of the sluice drive acts on the feed container via the stop and overcomes the container driving force of the feed container drive reduced to the second value.

12. The method according to claim 11, wherein the feed container is held in the abutment position when the sluice is moved in a second direction opposite to the first direction, by the feed container following the stop in the second direction by the container driving force of the feed container drive reduced to the second value.

13. The method according to claim 10, wherein the silo tube is a pressure-ventilated silo tube, and after reaching the abutment position, a closable outlet between the pressure-ventilated silo tube and the sluice is closed, the sluice being separately vented before a closable inlet of the sluice is opened.

14. A vibrator for building soil, the vibrator comprising:

a sluice with a silo tube, a sluice drive configured to move the sluice with a sluice driving force acting on the sluice, the sluice driving force being generated by a sluice motor, a feed container configured to feed a bulk material to the sluice, wherein the sluice is arranged to receive the bulk material from the feed container and guide the bulk material into the silo tube, a feed container drive configured to move the feed container between a waiting position and an abutment position against a stop formed on the sluice, the feed container drive exerting a container driving force on the feed container, the container driving force being generated by a container motor, and a controller of the feed container drive, wherein the controller is configured to:

reduce the container driving force of the feed container drive in a direction of the stop when the feed container is in the abutment position from a first value to a second value with a smaller absolute value than the sluice driving force of the sluice drive, and maintain the container driving force of the feed container drive acting in a direction of the stop after the feed container reaches the abutment position during feeding of the bulk material from the feed container into the sluice.

15. The vibrator according to claim 14, wherein the container motor is a hydraulic motor, a bypass being arranged in parallel with the hydraulic motor for fluidically bypassing the hydraulic motor, the bypass comprising a bypass valve configured to open and close the bypass, the bypass valve being controlled by the controller of the feed container drive.

16. The vibrator according to claim 15, wherein the container driving force of the feed container drive has the first value when the bypass is closed and the second value when the bypass is open.

17. The vibrator according to claim 15, wherein the bypass comprises an adjustable pressure relief valve.

18. The vibrator according to claim 15, wherein the sluice comprises a closable inlet and a closable outlet, wherein the closable inlet is opened for taking the bulk material from the feed container into the sluice and the closable outlet is opened to direct the bulk material from the sluice into the silo tube.

* * * * *